US007999761B2

(12) United States Patent
Kim et al.

(10) Patent No.: US 7,999,761 B2
(45) Date of Patent: Aug. 16, 2011

(54) PLASMA DISPLAY APPARATUS AND METHOD OF DRIVING THE SAME

(75) Inventors: Sonic Kim, Incheon-si (KR); Jung Gwan Ilan, Gyeongsangbuk-do (KR); An Soo Kim, Gyeongsangbuk-do (KR)

(73) Assignee: LG Electronics Inc., Seoul (KR)

( * ) Notice: Subject to any disclaimer, the term of this patent is extended or adjusted under 35 U.S.C. 154(b) by 1012 days.

(21) Appl. No.: 11/437,735

(22) Filed: May 22, 2006

(65) Prior Publication Data

US 2006/0262037 A1 Nov. 23, 2006

(30) Foreign Application Priority Data

May 23, 2005 (KR) ..... 10-2005-0043299

(51) Int. Cl.
*G09G 3/28* (2006.01)

(52) U.S. Cl. ..... 345/60; 313/231.31

(58) Field of Classification Search ..... 345/30–72; 313/231.31

See application file for complete search history.

(56) References Cited

U.S. PATENT DOCUMENTS

| | | | | |
|---|---|---|---|---|
| 6,285,128 | B1 | 9/2001 | Amemiya | |
| 2002/0105270 | A1 * | 8/2002 | Terao et al. | 313/586 |
| 2003/0193487 | A1 * | 10/2003 | Yatsuda et al. | 345/204 |
| 2004/0021653 | A1 * | 2/2004 | Kim et al. | 345/204 |

FOREIGN PATENT DOCUMENTS

| | | | |
|---|---|---|---|
| JP | 08-255574 | * | 1/1996 |
| KR | 1020020018889 | A | 9/2000 |
| KR | 1020040007114 | A | 1/2004 |
| WO | WO-2004/053918 | A1 | 6/2004 |

* cited by examiner

*Primary Examiner* — Amare Mengistu
*Assistant Examiner* — Vinh Lam
(74) *Attorney, Agent, or Firm* — Birch, Stewart, Kolasch & Birch, LLP

(57) ABSTRACT

A plasma display apparatus and a driving method of thereof are provided. The plasma display apparatus comprises a plasma display panel comprising a plurality of first address electrodes and a plurality of second address electrodes, and a data driver for supplying a voltage of a substantially equal magnitude to a last first address electrode of at least one side of the plurality of first address electrodes and at least one second address electrode.

6 Claims, 6 Drawing Sheets

(a)

(b)

(a)

(b)

PLASMA DISPLAY APPARATUS AND METHOD OF DRIVING THE SAME

This Nonprovisional application claims priority under 35 U.S.C. §119(a) on Patent Application No. 2005-0043299 filed in Korea on May 23, 2005 the entire contents of which are hereby incorporated by reference.

BACKGROUND OF THE INVENTION

1. Field of the Invention

This document relates to a display apparatus, and more particularly, to a plasma display apparatus and a method of driving the plasma display apparatus.

2. Description of the Background Art

A plasma display apparatus among various kinds of display apparatuses comprises a plasma display panel and a driver for driving the plasma display panel.

The plasma display panel comprises cells formed by barrier ribs formed between a front panel and a rear panel. Each of the cells is filled with an inert gas containing a main discharge gas such as neon (Ne), helium (He) or a Ne—He gas mixture and a small amount of xenon (Xe).

When a high frequency voltage generates a discharge, the inert gas within the cells generates vacuum ultraviolet rays. The vacuum ultraviolet rays emit a phosphor formed between the barrier ribs such that the image is displayed. Since the above-described plasma display panel can be manufactured to be thin and light, the plasma display panel has been considered as a next generation display apparatus.

FIG. 1 illustrates a disposition structure of a discharge cell of a related art plasma display panel.

As shown in FIG. 1, a discharge cell of a plasma display panel is formed at all of intersection point of scan electrodes Y1 to Ym, sustain electrodes Z1 to Zm, and address electrodes X1 to Xn.

A scan signal and a sustain signal are supplied to the scan electrodes Y1 to Ym such that the discharge cells are scanned in line units and a discharge is maintained within the discharge cells.

A sustain signal is commonly supplied to the sustain electrodes Z1 to Zm such that a discharge is maintained within the discharge cells.

A data signal synchronized with the scan signal is supplied to the address electrodes X1 to Xn in line units such that discharge cells, in which the discharge will be maintained, are selected in accordance with a logical value of the data signal.

The discharge cell of the plasma display panel having the above-described structure comprises an effective surface, on which an image is displayed, and a non-effective surface on which no image is displayed. A dummy discharge cell, in which no light is generated, is formed on the non-effective surface.

The address electrode located in the outermost line of the effective surface and the address electrode located in the non-effective surface closest to the outermost address electrode are shorted when the coalescing plasma display panel, such that a data integrated circuit is damaged. The damage of the data integrated circuit generates an erroneous discharge.

SUMMARY OF THE INVENTION

Accordingly, an object of the present invention is to solve at least the problems and disadvantages of the background art.

According to one aspect, there is provided a plasma display apparatus comprising a plasma display panel comprising a plurality of first address electrodes and a plurality of second address electrodes, and a data driver for supplying a voltage of a substantially equal magnitude to a last first address electrode of at least one side of the plurality of first address electrodes and to at least one second address electrode.

According to another aspect, there is provided a method of driving a plasma display apparatus for driving a plasma display panel comprising an electrode, the method comprising supplying a reset signal to a scan electrode during a reset period of at least one subfield, and supplying an address signal with a voltage of a substantially equal magnitude to a last address electrode of at least one side of a plurality of first address electrodes and at least one second address electrode of a plurality of second address electrodes, during an address period of at least one subfield which follows the supply of the reset signal.

According to still another aspect, there is provided a method of driving a plasma display apparatus comprising a first panel comprising a scan electrode and a sustain electrode, a second panel comprising a plurality of address electrodes and a barrier rib, and a driver for supplying a driving signal for driving the plurality of address electrodes, the method comprising supplying a reset signal to the scan electrode during a reset period of at least one subfield, and supplying an address signal with a voltage of a substantially equal magnitude to a last address electrode of at least one side of a plurality of first address electrodes and at least one second address electrode of a plurality of second address electrodes, during an address period of at least one subfield which follows the supply of the reset signal.

BRIEF DESCRIPTION OF THE DRAWINGS

The invention will be described in detail with reference to the following drawings in which like numerals refer to like elements.

DETAILED DESCRIPTION OF PREFERRED EMBODIMENTS

Figure 1:
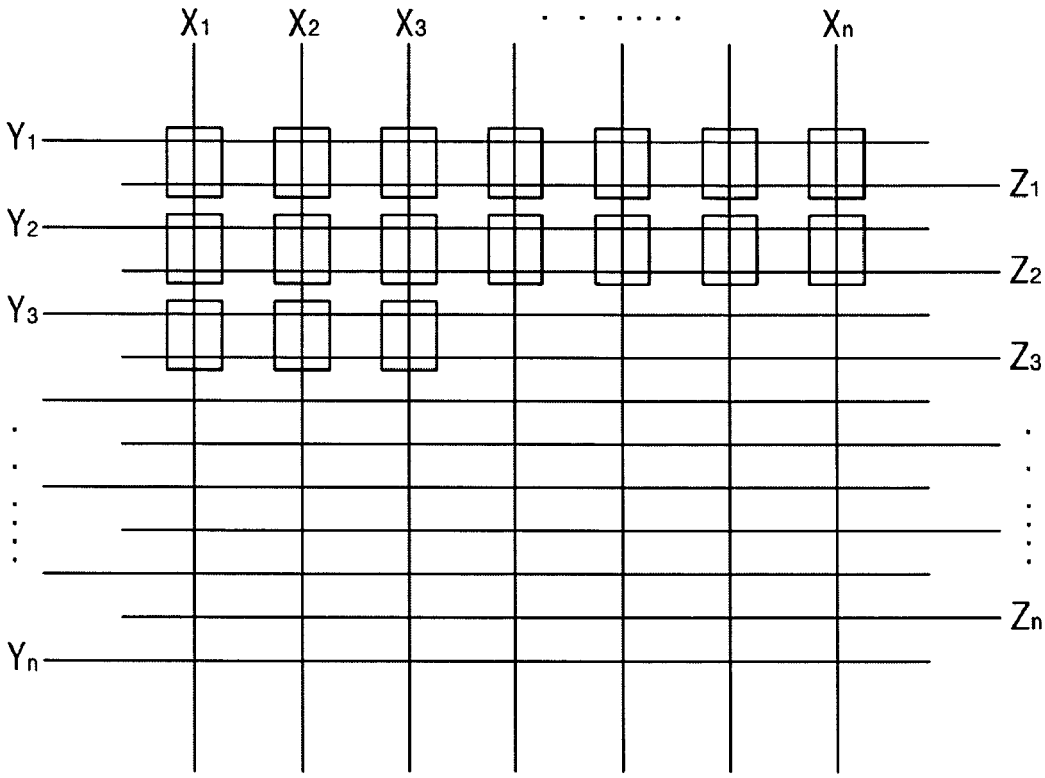
Fig. 1 RELATED ART
FIG. 1 illustrates a disposition structure of a discharge cell of a related art plasma display panel.

Preferred embodiments of the present invention will be described in a more detailed manner with reference to the drawings.

A plasma display apparatus according to embodiments of the present invention comprises a plasma display panel comprising a plurality of first address electrodes and a plurality of second address electrodes, and a data driver for supplying a voltage of a substantially equal magnitude to a last first address electrode of at least one side of the plurality of first address electrodes and to at least one second address electrode.

The plurality of first address electrodes may be located on an effective surface of the plasma display panel, and the plurality of second address electrodes may be located on a non-effective surface of the plasma display panel.

The data driver may supply a voltage of a magnitude, which is substantially equal to a magnitude of a voltage supplied to the plurality of second address electrodes, to the last first address electrodes on both sides of the plurality of first address electrodes.

The plurality of second address electrodes may be adjacent to the last first address electrode.

The plurality of second address electrodes may be located on at least one dummy cell.

At least one dummy cell may be formed in an extension direction of the address electrode.

A voltage of a magnitude substantially equal to a magnitude of a voltage supplied to the last first address electrode may be supplied to the plurality of second address electrodes.

A voltage supplied to the last first address electrode and the second address electrode may equal a logical value of "Low" or "High".

A voltage of the logical value "Low" may equal a ground level voltage.

A voltage of the logical value "High" may equal a voltage of about 5V.

A method of driving a plasma display apparatus for driving a plasma display panel comprising an electrode according to embodiments of the present invention, the method comprises supplying a reset signal to a scan electrode during a reset period of at least one subfield, and supplying an address signal with a voltage of a substantially equal magnitude to a last address electrode of at least one side of a plurality of first address electrodes and to at least one second address electrode of a plurality of second address electrodes, during an address period of at least one subfield following the supplying of the reset signal.

The plurality of first address electrodes may be located on an effective surface of the plasma display panel, and the plurality of second address electrodes may be located on a non-effective surface of the plasma display panel.

The plurality of second address electrodes may be adjacent to the last first address electrode.

A voltage supplied to the last first address electrode and the second address electrode may equal a logical value of "Low" or "High".

A voltage of the logical value "Low" may be a ground level voltage, and a voltage of the logical value "High" may equal a voltage of about 5V.

A method of driving a plasma display apparatus comprising a first panel comprising a scan electrode and a sustain electrode, a second panel comprising a plurality of address electrodes and a barrier rib, and a driver for supplying a driving signal for driving the plurality of address electrodes according to embodiments of the present invention, the method comprises supplying a reset signal to the scan electrode during a reset period of at least one subfield, and supplying an address signal with a voltage of a substantially equal magnitude to a last address electrode of at least one side of a plurality of first address electrodes and to at least one second address electrode of a plurality of second address electrodes, during an address period of at least one subfield which follows the supply of the reset signal.

The plurality of first address electrodes may be located on an effective surface of a plasma display panel, and the plurality of second address electrodes may be located on a non-effective surface of a plasma display panel.

The plurality of second address electrodes may be adjacent to the last first address electrode.

A voltage supplied to the last first address electrode and the second address electrode may equal a logical value of "Low" or "High".

A voltage of the logical value "Low" may be a ground level voltage, and a voltage of the logical value "High" may equal a voltage of about 5V.

Hereinafter, exemplary embodiments of the present invention will be described in detail with reference to the attached drawings.

Figure 2:
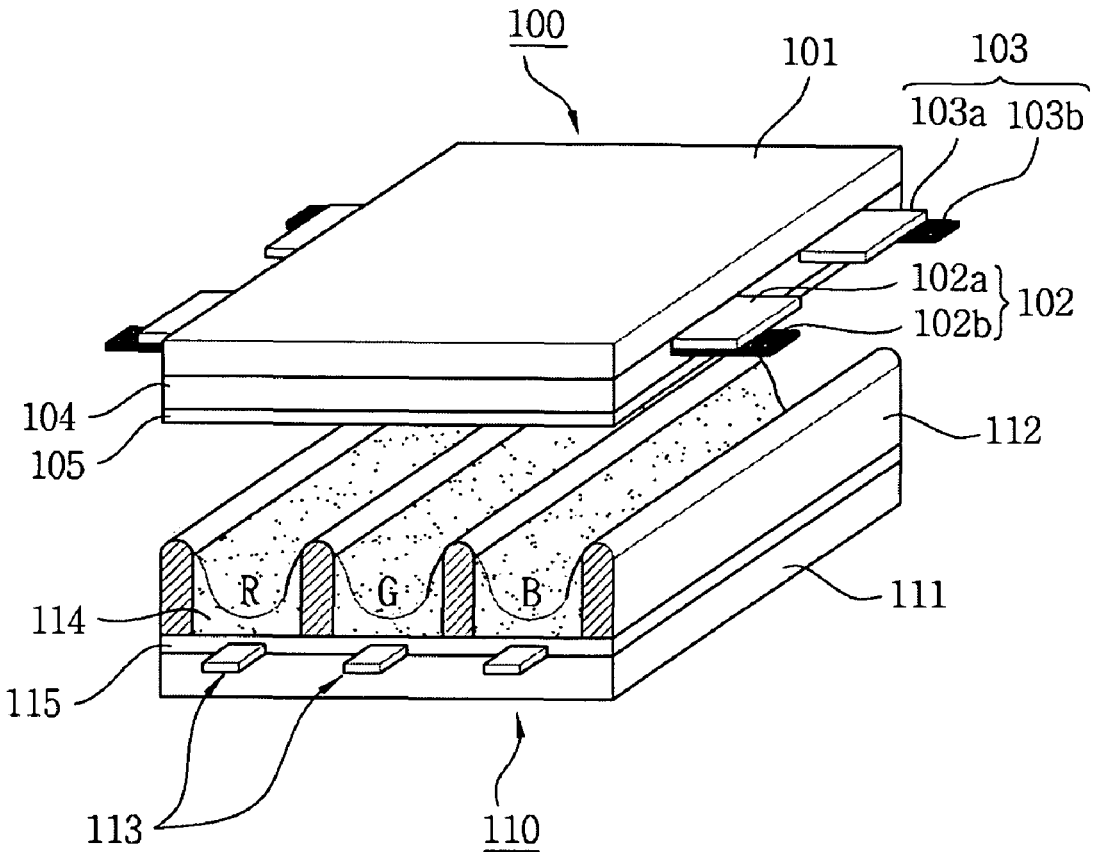
FIG. 2 illustrates a structure of a plasma display panel of a plasma display apparatus according to an embodiment of the present invention.

FIG. 2 illustrates a structure of a plasma display panel of a plasma display apparatus according to an embodiment of the present invention.

As shown in FIG. 2, the plasma display panel comprises a front panel 100 and a rear panel 110 which are coupled in parallel to oppose to each other at a given distance therebetween. A plurality of scan electrodes 102 and a plurality of sustain electrodes 103 are formed in pairs on a front glass substrate 101 of the front panel 100 being a display surface, on which an image is displayed, to form a plurality of maintenance electrode pairs. A plurality of address electrodes 113 are arranged on a rear glass substrate 111 of the rear panel 110 constituting a rear surface to intersect the plurality of maintenance electrode pairs.

The scan electrode 102 and the sustain electrode 103 each comprise transparent electrodes 102*a* and 103*a* made of a transparent indium-tin-oxide (ITO) material and bus electrodes 102*b* and 103*b* made of a metal material. The scan electrode 102 and the sustain electrode 103 generate a mutual discharge therebetween in one discharge cell and maintain emissions of discharge cells.

The scan electrode 102 and the sustain electrode 103 are covered with one or more upper dielectric layers 104 for limiting a discharge current and providing insulation between the maintenance electrode pairs. A protective layer 105 with a deposit of MgO is formed on an upper surface of the upper dielectric layer 104 to facilitate discharge conditions.

A plurality of stripe-type (or well-type) barrier ribs 112 are formed in parallel on the rear panel 110 to form a plurality of discharge spaces, that is, a plurality of discharge cells.

The plurality of address electrodes 113 are arranged in parallel with the barrier ribs 112 to perform an address discharge and generate vacuum ultraviolet rays. Red (R), green (G) and blue (B) phosphors 114 are coated on an upper surface of the rear panel 110 to emit visible light for displaying an image during the generation of the address discharge. A lower dielectric layer 115 is formed between the address electrodes 113 and the phosphors 114 to protect the address electrodes 113.

Figure 3:
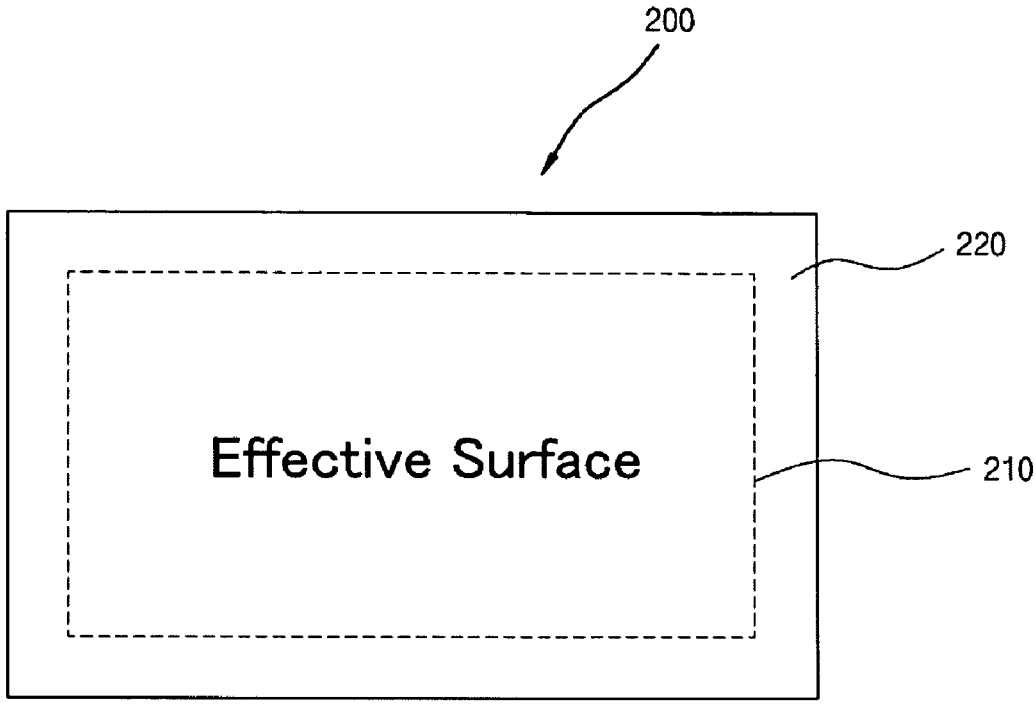
FIG. 3 illustrates a part of the plasma display panel, on which an image is displayed, in the plasma display apparatus according to the embodiment of the present invention.

FIG. 3 illustrates a part of the plasma display panel, on which an image is displayed, in the plasma display apparatus according to the embodiment of the present invention.

As shown in FIG. 3, the discharge cell of the plasma display panel comprises an effective surface 210, on which an image is displayed, and a non-effective surface 220, on which no image is displayed. A dummy discharge cell, in which no light is generated, is formed on the non-effective surface 220.

Further, the dummy discharge cell may be defined depending on whether an image is displayed or not, whether the phosphor formed on the discharge cell exists or not, and whether an image is shown or not through eyes of a user.

Figure 4:
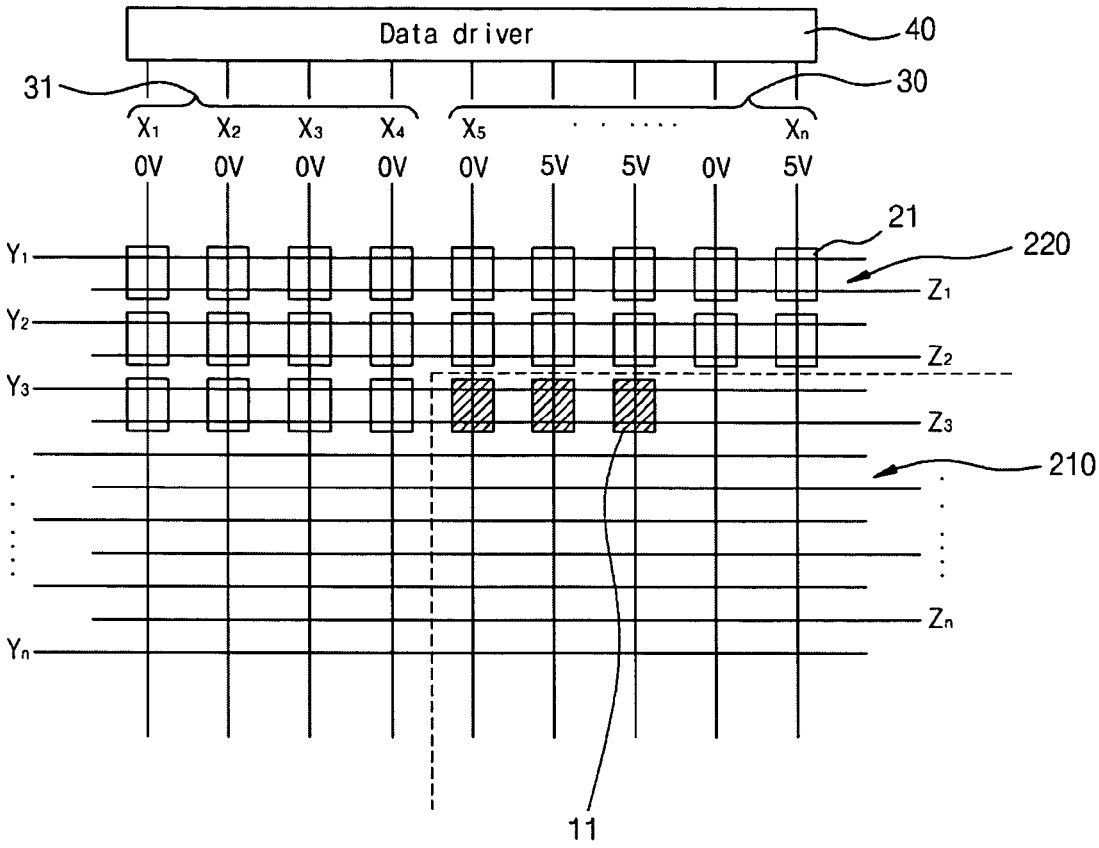
FIG. 4 illustrates a voltage value input to the plasma display apparatus according to the embodiment of the present invention.

FIG. 4 illustrates a voltage value input to the plasma display apparatus according to the embodiment of the present invention.

As shown in FIG. 4, the plasma display apparatus according to the embodiment of the present invention comprises a plasma display panel 200 and a data driver 40. The plasma display panel 200 comprises a plurality of address electrodes $X_1$ to Xn.

The plasma display panel 200 comprises a plurality of first address electrodes 30, $X_5$, . . . , Xn and a plurality of second address electrodes 31, $X_1$, $X_2$, $X_3$, $X_4$. The plurality of first address electrodes 30, $X_5$, . . . , Xn are located on the effective surface 210 of the plasma display panel 200 and the plurality of second address electrodes 31, $X_1$, $X_2$, $X_3$, $X_4$ are located on the non-effective surface 220 of the plasma display panel 200.

The data driver 40 supplies a voltage of a substantially equal magnitude to the last first address electrode $X_5$ of at least one side of the plurality of first address electrodes 30, $X_5$, . . . , Xn and at least one second address electrode 31 of the plasma display panel 200.

For example, the plurality of address electrodes $X_1$, $X_2$, $X_3$, $X_4$, $X_5$, . . . , Xn are formed on the plasma display panel 200. The data driver 40 supplies a voltage of a predetermined magnitude to a discharge cell 11 of the effective surface 210 and a dummy discharge cell 21 of the non-effective surface 220.

As shown in FIG. 4, the data driver 40 supplies the voltage of logical value "Low" to the dummy discharge cell 21 of the non-effective surface 220.

A voltage of logical value "Low" equal to the logical value supplied to the address electrode $X_4$ formed on the non-effective surface 220 is supplied to the address electrode $X_5$ of the effective surface 210 formed in a boundary between the effective surface 210 and the non-effective surface 220. It is preferable that the voltage of "Low" logical value equals a ground level voltage.

The ground level voltage or a voltage of about 5 V is selectively supplied to the remaining address electrodes $X_6$, . . . , Xn of the effective surface 210.

The data driver 40 for controlling the voltage supplied to the address electrodes $X_1$, . . . , Xn supplies a voltage of an equal magnitude to the last first address electrode $X_5$ of at least one side of the plurality of first address electrodes $X_5$, . . . , Xn of the effective surface 210 and the plurality of second address electrodes $X_1$, $X_2$, $X_3$, $X_4$ of the non-effective surface 220 in the electrode order adjacent to the last first address electrode $X_5$. Further, the data driver 40 may supply a voltage of an equal magnitude to only the last first address electrode $X_5$ of the effective surface 210 and the second address electrode $X_4$ of the non-effective surface 220.

In the embodiment of the present invention, the non-effective surface 220 of the plasma display panel 200 is located outside the effective surface 210. At least one dummy discharge cell 21, in which no discharge is generated, is formed on the non-effective surface 220. The plurality of dummy discharge cells 21 may be formed in an extension direction of the address electrode.

Figure 5:
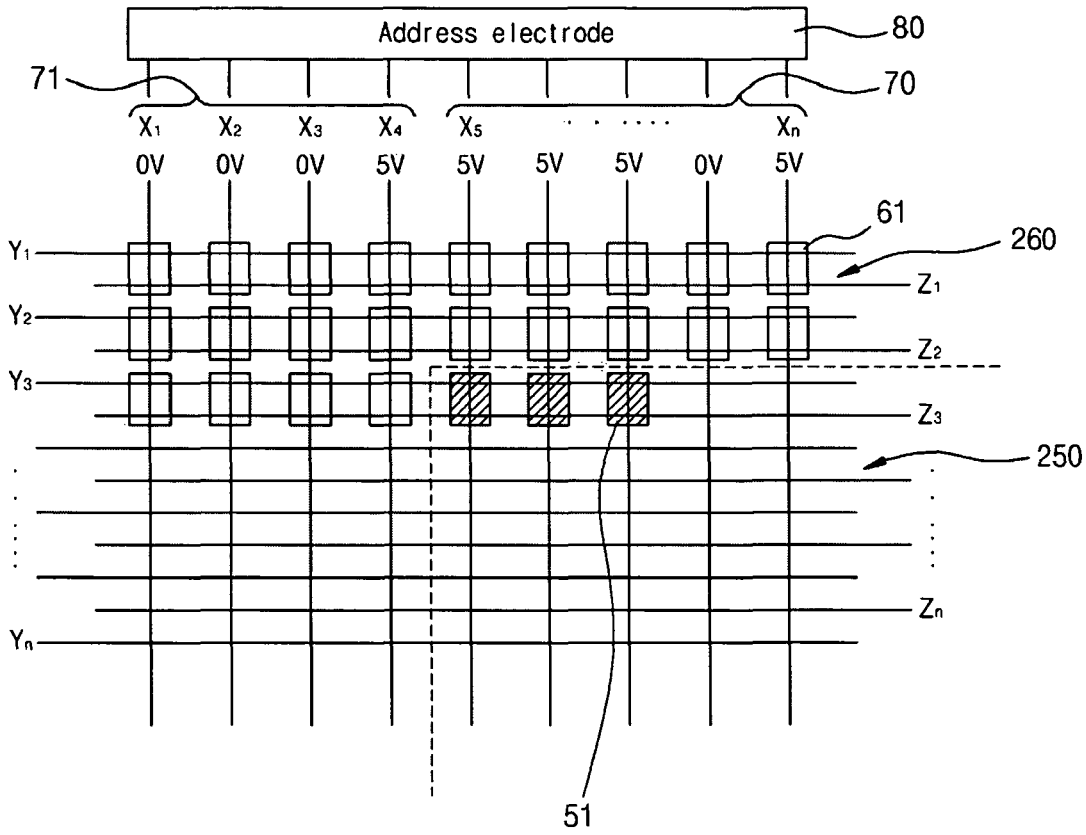
FIG. 5 illustrates a voltage value input to a plasma display apparatus according to another embodiment of the present invention.

FIG. 5 illustrates a voltage value input to a plasma display apparatus according to another embodiment of the present invention.

As shown in FIG. 5, a data driver 80 of the plasma display apparatus according to another embodiment of the present invention supplies a voltage of a logical value "High" to the last first address electrode $X_5$ of at least one side of a plurality of first address electrodes 70, $X_5$, . . . , $X_n$ of a plasma display panel. Further, the data driver 80 supplies a voltage of a logical value "Low" to a plurality of second address electrodes 71, $X_1$, $X_2$, $X_3$ of a non-effective surface 260.

Thus, a voltage of a logical value "Low" is supplied to the address electrodes $X_1$, $X_2$, $X_3$ of a dummy discharge cell 61 of the non-effective surface 260. A voltage of a logical value "High" equal to the logical value supplied to the address electrode $X_5$ of an effective surface 250 is supplied to the address electrode $X_4$ of the non-effective surface 260 formed in a boundary between the effective surface 250 and the non-effective surface 260.

In other words, when a voltage of the logical value "High" is supplied to the last first address electrode $X_5$ of at least one side of the plurality of first address electrodes 70, $X_5$, . . . , $X_n$, the voltage of the logical value "High" is supplied to at least one address electrode $X_4$ of the non-effective surface 260 adjacent to the last first address electrode $X_5$. Further, when a voltage of the logical value "Low" is supplied to the last first address electrode $X_5$, the voltage of the logical value "Low" is supplied to at least one address electrode $X_4$ of the non-effective surface 260 adjacent to the last first address electrode $X_5$.

The embodiments of the present invention are described that a voltage of the logical values "Low" and "High" equals a ground level voltage and a voltage of about 5V, respectively. However, the logical values "Low" and "High" may be selectively set to various voltages such as −5V, 0V, 5V, 10V, 12V, 24V.

Accordingly, a damage of the data driver 80 caused by the short of the address electrodes $X_1$, $X_2$, $X_3$, $X_4$ of the non-effective surface or the address electrodes $X_5$, . . . , $X_n$ of the effective surface when coalescing the plasma display panel is prevented.

Figure 6:
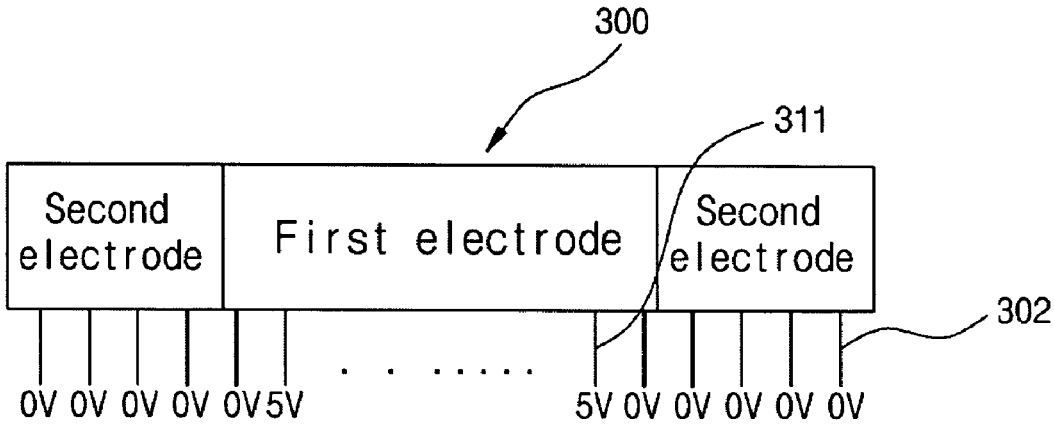
FIG. 6 illustrates a voltage value input to a data driver of a plasma display apparatus according to still another embodiment of the present invention.
Figure 6:
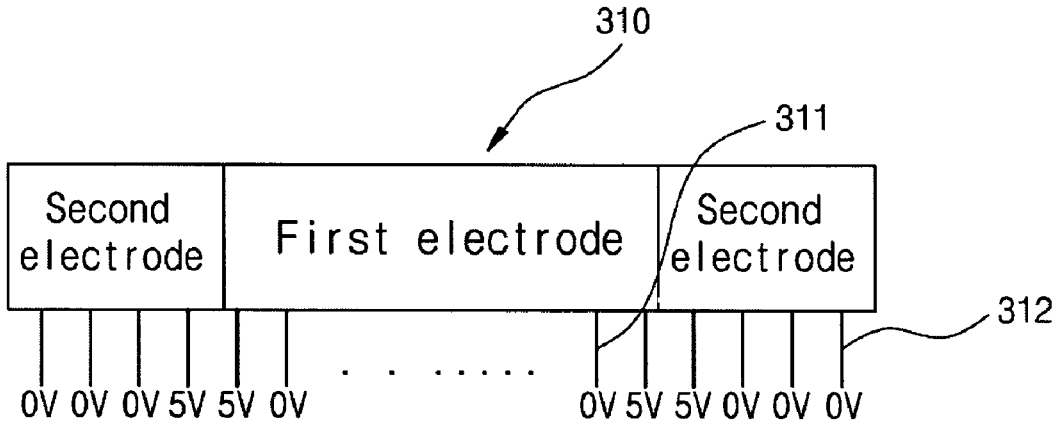

FIG. 6 illustrates a voltage value input to a data driver of a plasma display apparatus according to still another embodiment of the present invention.

As shown in FIG. 6, the data driver of the plasma display apparatus according to still another embodiment of the present invention supplies a value of a substantially equal magnitude to a last first address electrode 301 of at least one side of a plurality of first address electrodes and at least one address electrode 302 of a plurality of second address electrodes.

Referring to (a) of FIG. 6, a data driver 300 supplies a value of a logical value "Low", that is, a ground level voltage to a last first address electrode 301 of at least one side of the plurality of first address electrodes and at least one address electrode 302 of a plurality of second address electrodes. Thus, a damage of the data driver 300 caused by short of the adjacent address electrodes 301 and 302 is prevented.

Referring to (b) of FIG. 6, a data driver 310 supplies a value of a logical value "High", that is, a voltage of 5V to a last first address electrode 311 of at least one side of the plurality of first address electrodes and at least one address electrode 312 of a plurality of second address electrodes.

Thus, a damage of the data driver 310 caused by short of the adjacent address electrodes 311 and 312 is prevented.

In the present embodiment, the voltage supplied to the first address electrodes and the second address electrodes equals the logical value "Low", the ground level voltage, the logical value "High", and about 5V. However, the logical values "Low" and "High" may be set to various voltages such as −5V, 10V, 12V, 24V.

As described above, according to the embodiments of the present invention, since a voltage of a substantially equal magnitude is supplied to the adjacent first address electrode and the second address electrode, a damage of the data integrated circuit caused by short of the adjacent first and second address electrodes is prevented.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A plasma display apparatus, comprising:

a plasma display panel comprising a plurality of first address electrodes disposed on an effective surface of the plasma display panel and a plurality of second address electrodes disposed on a non-effective surface of the plasma display panel and electrically disconnected from the plurality of first address electrodes; and a data driver supplying a voltage of a substantially equal magnitude to an outermost one of the plurality of first address electrodes and to at least one of the plurality of second address electrodes, wherein the at least one of the plurality of second address electrodes is adjacent to the outermost first address electrode, wherein a voltage supplied to the outermost first address electrode and the at least one of the plurality of second address electrodes equals a logical value of "Low" or "High", wherein a voltage of other second address electrodes than the at least one of the plurality of second address electrodes is maintained at the logical value of "Low" when the voltage supplied to the outermost first address electrode and the at least one of the plurality of second address electrodes equals the logical value of "High", and wherein the voltage of the logical value "Low" equals a ground level voltage, and the voltage of the logical value "High" equals a voltage higher than the ground level voltage.

2. The plasma display apparatus of claim 1, wherein the plurality of second address electrodes are located on at least one dummy cell.

3. The plasma display apparatus of claim 2, wherein the at least one dummy cell is formed in an extension direction of one of the plurality of second address electrodes.

4. The plasma display apparatus of claim 1, wherein the voltage of the logical value "High" equals a voltage of about 5V.

5. A method of driving a plasma display apparatus comprising a first panel comprising a scan electrode and a sustain electrode, a second panel comprising a plurality of address electrodes and a barrier rib, and a driver supplying a driving signal for driving the plurality of address electrodes, wherein a plurality of first address electrodes are disposed on an effective surface of the plasma display panel and a plurality of second address electrodes are disposed on a non-effective surface of the plasma display panel, the plurality of second address electrodes being electrically disconnected from the plurality of first address electrodes, the method comprising:

supplying a reset signal to the scan electrode during a reset period of at least one subfield; and supplying an address signal with a voltage of a substantially equal magnitude to an outermost one of the plurality of first address electrodes and to at least one of the plurality of second address electrodes, during an address period of at least one subfield following the supplying of the reset signal, wherein the at least one of the plurality of second address electrodes is adjacent to the outermost first address electrode, wherein a voltage supplied to the outermost first address electrode and the at least one of the plurality of second address electrodes equals a logical value of "Low" or "High", wherein a voltage of other second address electrodes than the at least one of the plurality of second address electrodes is maintained at the logical value of "Low" when the voltage supplied to the outermost first address electrode and the at least one of the plurality of second address electrodes equals the logical value of "High", and wherein the voltage of the logical value "Low" equals a ground level voltage, and the voltage of the logical value "High" equals a voltage higher than the ground level voltage.

6. A plasma display apparatus, comprising:

a plasma display panel comprising first address electrodes disposed on an effective surface of the plasma display panel, and second address electrodes disposed on a non-effective surface of the plasma display panel and electrically disconnected from the first address electrodes, the second address electrodes comprising at least two address electrodes, a data driver supplying a voltage of a substantially equal magnitude to an outermost one of the first address electrodes and to one of the at least two address electrodes, wherein the one of the at least two address electrodes is adjacent to the outermost one of the first address electrode, wherein a voltage supplied to the outermost first address electrode and the at least one of the plurality of second address electrodes equals a logical value of "Low" or "High", wherein a voltage of other second address electrodes than the at least one of the plurality of second address electrodes is maintained at the logical value of "Low" when the voltage supplied to the outermost first address electrode and the at least one of the plurality of second address electrodes equals the logical value of "High", and wherein the voltage of the logical value "Low" equals a ground level voltage, and the voltage of the logical value "High" equals a voltage higher than the ground level voltage.

* * * * *